US009312080B2

(12) United States Patent
Boeck et al.

(10) Patent No.: US 9,312,080 B2
(45) Date of Patent: Apr. 12, 2016

(54) POWER TOOL

(71) Applicant: Robert Bosch GmbH, Stuttgart (DE)

(72) Inventors: Cornelius Boeck, Kirchheim (DE); Daniel Barth, Leinfelden-Echterdingen (DE); Joachim Schadow, Stuttgart (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 1 day.

(21) Appl. No.: 14/366,468

(22) PCT Filed: Nov. 15, 2012

(86) PCT No.: PCT/EP2012/072732
§ 371 (c)(1),
(2) Date: Jun. 18, 2014

(87) PCT Pub. No.: WO2013/092027
PCT Pub. Date: Jun. 27, 2012

(65) Prior Publication Data

US 2015/0034465 A1 Feb. 5, 2015

(30) Foreign Application Priority Data

Dec. 23, 2011 (DE) ..... 10 2011 089 729

(51) Int. Cl.
*B24B 23/02* (2006.01)
*H01H 9/06* (2006.01)

(52) U.S. Cl.
CPC ..... *H01H 9/06* (2013.01); *B24B 23/028* (2013.01); *H01H 9/063* (2013.01)

(58) Field of Classification Search
CPC ..... B24B 23/028; B24B 23/02; B24B 23/04; B24B 23/00; H01H 9/06; H01H 9/063; B34D 15/04; B34D 15/023
USPC ..... 451/344, 356–359
See application file for complete search history.

(56) References Cited

U.S. PATENT DOCUMENTS

| | | | | |
|---|---|---|---|---|
| 4,033,077 | A | 7/1977 | Chester et al. | |
| 4,276,459 | A * | 6/1981 | Willett et al. | 200/43.17 |
| 4,879,438 | A * | 11/1989 | Winchester | 200/61.85 |
| 5,201,146 | A * | 4/1993 | Fushiya | 451/358 |
| 5,407,381 | A * | 4/1995 | Schaefer et al. | 451/358 |
| 5,681,214 | A * | 10/1997 | Kleider et al. | 451/358 |
| D392,529 | S * | 3/1998 | Goto | D8/62 |

(Continued)

FOREIGN PATENT DOCUMENTS

| | | |
|---|---|---|
| DE | 197 07 215 A1 | 9/1997 |
| DE | 199 00 404 A1 | 7/2000 |
| EP | 2 101 340 A1 | 9/2009 |

OTHER PUBLICATIONS

International Search Report corresponding to PCT Application No. PCT/EP2012/072732, mailed Jul. 22, 2013 (German and English language document) (5 pages).

*Primary Examiner* — George Nguyen
(74) *Attorney, Agent, or Firm* — Maginot, Moore & Beck LLP

(57) ABSTRACT

A power tool includes at least one grip housing having at least one handle-shaped grip region and at least one switching unit having at least one movably mounted latch element. The at least one movably mounted latch element has a maximum width that extends over at least a major part of at least one maximum width of the at least one handle-shaped grip region of the at least one grip housing.

11 Claims, 2 Drawing Sheets

(56) References Cited

U.S. PATENT DOCUMENTS

| | | | | |
|---|---|---|---|---|
| 6,464,573 | B1 * | 10/2002 | Keller | 451/451 |
| 6,602,122 | B1 * | 8/2003 | Rudolf et al. | 451/344 |
| 6,962,523 | B2 * | 11/2005 | Fraser et al. | 451/259 |
| 7,497,766 | B2 * | 3/2009 | Kraenzler et al. | 451/360 |
| 7,537,065 | B2 * | 5/2009 | Gallagher et al. | 173/170 |
| 8,752,646 | B2 * | 6/2014 | Fujiwara et al. | 173/217 |
| 2010/0009608 | A1 | 1/2010 | Lo et al. | |

* cited by examiner

POWER TOOL

This application is a 35 U.S.C. §371 National Stage Application of PCT/EP2012/072732, filed on Nov. 15, 2012, which claims the benefit of priority to Serial No. DE 10 2011 089 729.1, filed on Dec. 23, 2011 in Germany, the disclosures of which are incorporated herein by reference in their entirety.

BACKGROUND

Already known from DE 197 07 215 A1 is a power tool, in particular an angle grinder, which comprises a handle housing having a stem-type grip region, and which comprises a switching unit that has a movably mounted latch element.

SUMMARY

The disclosure is based on a power tool, in particular an angle grinder, comprising at least one handle housing having at least one stem-type grip region, and comprising at least one switching unit that has at least one movably mounted latch element.

It is proposed that the latch element have a maximum transverse extent that extends at least over a major part of at least one maximum transverse extent of the stem-type grip region of the handle housing. The power tool is preferably realized as a portable power tool, in particular as a portable, hand-held power tool. A "portable power tool" is to be understood here to mean, in particular, a power tool for performing work on workpieces, that can be transported by an operator without the use of a transport machine. The portable power tool has, in particular, a mass of less than 40 kg, preferably less than 10 kg, and particularly preferably less than 7 kg. Particularly preferably, the portable power tool is preferably realized as an angle grinder. It is also conceivable, however, for the portable power tool to be of a different design, considered appropriate by persons skilled in the art, such as, for example, designed as a hammer drill and/or chipping hammer, power drill, saber saw, compass saw, hedge shears, etc.

A "handle housing" is to be understood here to mean, in particular, at least one housing or at least one housing sub-region that, to a large extent, is dissociated from a mounting of a drive unit and/or output unit of the power tool, wherein at least one grip region of the housing or of the housing sub-region, in particular a housing sub-region realized as a stem-type grip region, can be gripped by an operator, by at least one hand, at least to a large extent, for the purpose of handling the power tool. The expression "can be gripped to a large extent" is intended here to define, in particular, a capability whereby a component or a component region can be gripped by a hand of an operator along at least more than 70%, preferably more than 80%, and particularly preferably more than 90% of a total extent of a total outer circumference of the component or of the component region that runs in a plane extending at least substantially perpendicularly in relation to a direction of longitudinal extent of the component or of the component region, wherein the total extent of the total circumference is, in particular, less than 40 cm, preferably less than 30 cm, and particularly preferably less than 25 cm. Preferably, when the component or component region is gripped, a hand inner surface and finger inner surfaces of the hand of the operator are in contact with total outer circumference at least along a distance greater than 70%, preferably greater than 80%, and particularly preferably greater than 90% of the total extent of the total outer circumference. Preferably, the handle housing is realized so as to be separate from a drive housing of the power tool that is provided to accommodate the drive unit and/or output unit, in order to support drive bearing forces and/or output bearing forces. It is also conceivable, however, for the handle housing and the drive housing to be realized as a single piece. Preferably, the handle housing has a stem-type grip region. The expression "stem-type grip region" is intended here to define, in particular, a housing sub-region of the handle housing that, as viewed in a longitudinal sectional plane, in which the direction of main extent of the power tool extends, along a direction running at least substantially perpendicularly in relation to the direction of main extent, has a maximum extent, in particular, of less than 10 cm, preferably of less than 8 cm, and particularly preferably of less than 6 cm, wherein at least one operating surface of the handle housing is arranged in the housing sub-region of the handle housing. Preferably, the maximum extent, as viewed in the longitudinal sectional plane, is delimited by at least two parallel straight lines, or by at least two straight lines, inclined relative to each other by an angle of less than 10°, preferably of less than 8°, and particularly preferably of less than 6°, that are constituted by an outer contour of the housing sub-region of the handle housing. The stem-type grip region is inclined relative to a direction of main extent of the power tool, in particular, at least by an angle of less than 60°, preferably of less than 40°, and particularly preferably of less than 30°. Preferably, the stem-type grip region, as viewed along a rotation axis of a drive element, in particular of an armature shaft, a drive unit of the power tool, and in particular along the direction of main extent of the power tool, is arranged behind the drive unit. Moreover, it is conceivable for the handle housing, in addition to having the stem-type grip region, to have a bow-shaped sub-region, which is integrally formed on to the stem-type grip region. The bow-shaped sub-region may preferably be of an L-shaped design, which extends in an L shape in the direction of the connecting region, starting from an end of the stem-type grip region that faces away from the connecting region of the handle housing. Particularly preferably, the handle housing comprises at least two handle housing shell elements, which can be joined to each other in a joint plane. The handle housing thus preferably has a shell-type structure. It is also conceivable, however, for the handle housing to have a pot-type structure.

The term "switching unit" is intended there to define, in particular, a unit having at least one component, in particular the latch element, which can be actuated directly by an operator, and which is provided to influence and/or alter a process and/or a state of a unit coupled to the switching unit, through an actuation and/or through an input of parameters. The latch element is preferably provided for actuating at least one switching element of the switching unit. A "latch element" is to be understood here to mean, in particular, an operating element that, along a direction of longitudinal extent of the operating element, has a longitudinal extent that is greater than a transverse extent of the operating element that runs at least substantially perpendicularly in relation to the direction of longitudinal extent and runs at least substantially transversely in relation to a main direction of movement of the operating element. "Substantially transversely" is to be understood here to mean, in particular, an alignment of a direction and/or of an axis relative to a reference direction and/or to a reference axis, wherein the alignment of the direction and/or of the axis are at least different from an at least substantially parallel alignment in relation to the reference direction and/or to the reference axis and, in particular, are askew or perpendicular in relation to the reference direction and/or to the reference axis. Preferably, a maximum longitudinal extent of the latch element is at least 2 times greater, preferably at least 4 times greater, and particularly preferably at least 6 times greater than a maximum transverse extent of the latch element. The latch element has, in particular, a maximum longitudinal extent that is greater than 3 cm, preferably greater than 6 cm, and particularly preferably greater than 8 cm. In addition, the latch element preferably comprises an operating surface, in particular an operating surface constituted by a grip surface region of the latch element, on which an operator can place at least three fingers in order to actuate the latch element, and which has at least one longitudinal extent that is greater than 5 cm, running along the direction of longitudinal extent of the latch element.

The expression "substantially perpendicularly" is intended here to define, in particular, an alignment of a direction relative to a reference direction, wherein the direction and the reference direction, in particular as viewed in one plane, enclose an angle of 90° and the angle has a maximum deviation of, in particular, less than 8°, advantageously less than 5°, and particularly advantageously less than 2°. Preferably, the switching unit is provided to actuate the switching element by means of an actuation of the latch element, in order to open or close an electric circuit for supplying energy, at least to a drive unit of the power tool. The switching unit is thus preferably provided to enable the power tool to be put into operation or deactivated. "Provided" is to be understood to mean, in particular, specially designed and/or specially equipped. The switching element is preferably constituted by a mechanical, electrical and/or electronic switching element.

The expression "maximum transverse extent" is intended there to define, in particular, a maximum extent of a component or of a housing, in particular of a multipart housing, when in a mounted state, along a direction that runs at least substantially perpendicularly in relation to the direction of main extent of the power tool and at least substantially transversely at least in relation to a main direction of movement of the latch element. "Extend at least over a major part" is to be understood here to mean, in particular, a ratio of a maximum extent of the latch element, along at least one direction, relative to a maximum extent of the stem-type grip region of the handle housing, wherein a maximum extent of the latch element along the at least one direction corresponds to at least more than 40%, preferably more than 60%, and particularly preferably more than 80% of the maximum extent of the stem-type grip region of the handle housing along the at least one direction. A maximum transverse extent of the latch element thus corresponds to at least more than 40%, preferably more than 60%, and particularly preferably more than 80% of the maximum transverse extent of the stem-type grip region of the handle housing. Advantageously, by means of the design of the power tool according to the disclosure, it is possible to achieve an ergonomically appropriate design of the latch element. Advantageously, a high degree of operating comfort can thus be achieved.

Furthermore, it is proposed that a ratio of the maximum transverse extent of the latch element to the maximum transverse extent of the stem-type grip region of the handle housing be at least greater than 1 to 2.5. Preferably, the ratio of the maximum transverse extent of the latch element to the maximum transverse extent of the stem-type grip region of the handle housing is at least greater than 1 to 2 and, particularly preferably, the ratio is greater than 1 to 1.4. Advantageously, owing to an advantageous geometry of the latch element that can be achieved because of the ratio of the maximum transverse extent of the latch element to the maximum transverse extent of the stem-type grip region of the handle housing, only a small force is exerted upon inner surfaces of fingers and/or upon an inner surface of a hand of an operator when actuating the latch element.

It is additionally proposed that the latch element have a maximum longitudinal extent that extends at least over a major part of a maximum longitudinal extent of the stem-type grip region of the handle housing. In particular, a maximum longitudinal extent of the latch element corresponds, in particular, to more than 75%, preferably to more than 80%, and particularly preferably to more than 90% of the maximum longitudinal extent of the stem-type grip region of the handle housing. When the latch element and the handle housing are in a mounted state, the maximum longitudinal extent of the latch element and the maximum longitudinal extent of the stem-type grip region of the handle housing extend along a direction that runs in the joint plane of the handle housing in which the handle housing shell elements bear against each other, or are joined to each other, when in a mounted state, and that runs at least substantially transversely in relation to the main direction of movement of the latch element. Advantageously, a large usable operating surface of the latch element can be achieved. It is thus advantageously possible to create a latch element that is comfortable to operate. Advantageously, an operator can use at least three finger of one hand of the operator to actuate the latch element.

Advantageously, a ratio of the maximum longitudinal extent of the latch element to the maximum longitudinal extent of the stem-type grip region of the handle housing is at least greater than 1 to 1.4. Preferably, the ratio of the maximum longitudinal extent of the latch element to the maximum longitudinal extent of the stem-type grip region is at least greater than 1 to 1.3 and, particularly preferably, the ratio is greater than 1 to 1. Advantageously, comfortable actuation of the latch element can be achieved, at least substantially over the maximum longitudinal extent of the stem-type grip region. A high degree of operating comfort can thus be achieved.

It is additionally proposed that the latch element have at least one side wall region, which is connected, via a bow-shaped sub-region of the latch element, to a grip surface region of the latch element that runs at least substantially perpendicularly in relation to the side wall region, wherein a ratio of a radius of the bow-shaped sub-region to the maximum transverse extent of the stem-type grip region of the handle housing is at least greater than 1 to 8. Preferably, the ratio of the radius of the bow-shaped sub-region to the maximum transverse extent of the stem-type grip region of the handle housing is at least greater than 1 to 4 and, particularly preferably, the ratio is at least greater than 1 to 2.7. Preferably, when the latch element has been mounted on the handle housing, the side wall region runs along a direction that runs at least substantially parallelwise in relation to the joint plane of the handle housing. Moreover, when the latch element has been mounted on the handle housing, the grip surface region preferably runs along a direction that runs at least substantially perpendicularly in relation to the joint plane of the handle housing. Advantageously, by means of the design according to the disclosure, a large area of the latch element, in particular of the bow-shaped sub-region, is in contact with an inner surface of a hand, or inner surfaces of fingers of a hand, of an operator when the latch element is being operated, or held. Advantageously, this makes the latch element particularly comfortable to hold. Thus, advantageously, the latch element can be made very suitable for use over extended periods.

It is additionally proposed that the latch element be mounted so as to be pivotable about a pivot axis of the latch element. Particularly preferably, the pivot axis runs at least substantially perpendicularly in relation to the joint plane of the handle housing. Advantageously, an easily operated latch element can be created, with which a mounting is not susceptible to dirt accumulation. Moreover, advantageously, a lever action can be used for comfortable actuation of the switching unit by means of the latch element.

Advantageously, the pivot axis is arranged at an end of the latch element that faces toward a connecting region of the handle housing. The expression "connecting region" is to be understood here to mean, in particular, a region of the handle housing via which the handle housing is connected to the drive housing in a form closed, force closed and/or materially bonded manner, or by means of which the handle housing bears directly against the drive housing. An "end of the latch element that faces toward the connecting region" is to be understood here to mean, in particular, an arrangement of points of the latch element, in respect of a central plane of the latch element, that runs at least substantially perpendicularly in relation to the direction of longitudinal extent of the latch element, and that is arranged at least substantially equally from two ends of the latch element that are spaced apart from each other along the direction of longitudinal extent of the latch element, wherein all points of the latch element, that are arranged, starting from the central plane, in the direction of the connecting region, as viewed along the direction of longitudinal extent of the latch element, are considered to face toward the connecting region. By means of the design according to the disclosure, it is advantageously possible to achieve a compact arrangement of the latch element on the handle housing.

It is additionally proposed that the pivot axis of the latch element run at least substantially transversely in relation to a direction of main extent of the handle housing. The direction of main extent of the handle housing preferably runs at least substantially parallelwise in relation to the direction of main extent of the power tool. Preferably, the direction of main extent of the handle housing is identical to the direction of main extent of the power tool. Particularly preferably, the pivot axis of the latch element runs at least substantially perpendicularly in relation to the direction of main extent of the power tool. Advantageously, it is possible to achieve comfortable operation of the latch element.

It is additionally proposed that the power tool have at least one switch-on inhibitor unit, which is provided to avoid, at least to a large extent, a movement of the latch element as a result of an unintentional actuation of the latch element. A "switch-on inhibitor unit" is to be understood here to mean, in particular, a unit provided to prevent to a large extent a movement of a movably mounted component along at least one distance and/or about at least one axis, at least in an operating state, by means of a mechanical, electrical and/or electronic inhibitor. Preferably, the switch-on inhibitor unit is provided to prevent to a large extent a movement of the latch element, at least in an operating state, by means of a mechanical inhibitor. It is also conceivable, however, for the switch-on inhibitor unit to prevent to a large extent a movement of the latch element, at least in an operating state, by means of an electromagnetic action of force and/or a permanent-magnet action of force, such as, for example, by means of displaceable magnets, upon the latch element. Advantageously, by means of the design according to the disclosure, it is possible, to a large extent, to prevent the power tool being inadvertently put into operation.

Advantageously, the switch-on inhibitor unit has at least one release element, which comprises an actuating region that is arranged, at least partially, laterally next to a side wall region of the latch element. "Laterally next to" is to be understood here to mean, in particular, an arrangement of the actuating region of the release element relative to the latch element, wherein the actuating region, as viewed along a direction running at least substantially perpendicularly in relation to a side wall region of, in particular as viewed starting from the side wall region in a direction away from the handle housing, is arranged at a distance relative to the latch element. Advantageously, an ergonomically appropriate arrangement of the release element, in particular of the actuating region, can be achieved.

The disclosure is additionally based on a power tool switching device of a power tool according to the disclosure, wherein the power tool switching device comprises at least the switching unit. In addition, it is conceivable for the power tool switching device to have at least one bearing unit, for mounting the latch element in a movable manner. The bearing unit in this case may be realized as a translational bearing unit, as a rotational bearing unit, or of a combination of a translational bearing unit and a rotational bearing unit, such as, for example, a lever mechanism bearing unit, etc. In this case, the bearing unit is preferably of a design already known to persons skilled in the art. Thus, advantageously, already existing power tools can easily be retrofitted with the switching unit according to the disclosure and the bearing unit according to the disclosure.

The power tool according to the disclosure and/or the power tool switching device according to the disclosure are/is not intended in this case to be limited to the application and embodiment described above. In particular, the power tool according to the disclosure and/or the power tool switching device according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows an exemplary embodiment of the disclosure. The drawing, the description and the claims contain numerous features in combination. Persons skilled in the art will also expediently consider the features individually and combine them to create appropriate further combinations.

In the drawing.

DETAILED DESCRIPTION

Figure 1:
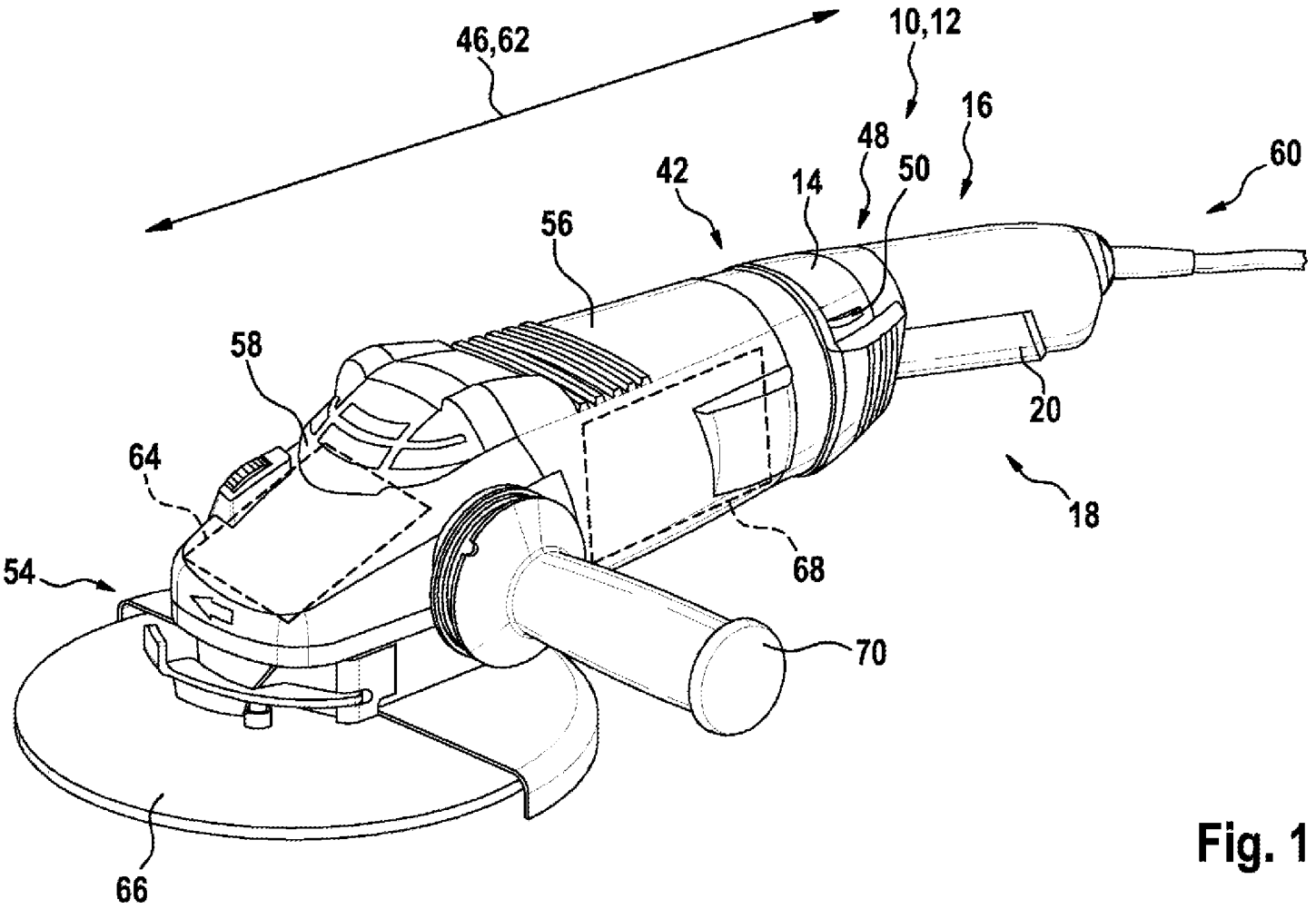
FIG. 1 shows a power tool according to the disclosure, in a schematic representation.

FIG. 1 shows a power tool 10, which is constituted by a portable power tool 10 realized as an angle grinder 12. The portable power tool 10 comprises at least one handle housing 14, which has at least one stem-type grip region 16, and at least one switching unit 18, which has at least one movably mounted latch element 20. The portable power tool 10 in this case has at least one power tool switching device, which comprises at least the switching unit 18. The stem-type grip region 16 of the handle housing 14 in this case constitutes a main handle of the portable power tool 10. In this case, the main handle constituted by the stem-type grip region 16 extends, at least substantially, starting from a connecting region 42 of the handle housing 14, in a direction away from the connecting region 42, as far as a side 60 of the handle housing 14 on which there is arranged a cable of the portable power tool 10, realized as an angle grinder 12, for supplying energy. The stem-type grip region 16 of the handle housing 14 is offset relative to a direction of main extent 46 of the handle housing 14, or relative to a direction of main extent 62 of the portable power tool 10, by an angle of less than 30°.

The portable power tool 10, realized as an angle grinder 12, additionally comprises a protective cover unit 54, a drive housing 56 and an output housing 58. Extending out from the output housing 58 there is an output shaft of an output unit 64 of the portable power tool 10, which is realized as a spindle (not represented in greater detail here), to which a working tool 66 can be fixed, for performing work on a workpiece (not represented in greater detail here). The working tool 66 is realized as an abrasive disk. It is also conceivable, however, for the working tool 66 to be realized as a parting disk or polishing disk.

The portable power tool 10 comprises the drive housing 56, for accommodating a drive unit 68 of the portable power tool 10, and the output housing 58, for accommodating the output unit 64. The drive unit 68 is provided to drive the working tool 66 in rotation, via the output unit 64. For the purpose of performing work on a workpiece, the working tool 66 in this case may be connected to the spindle in a rotationally fixed manner by means of a fastening element (not represented in greater detail here). The working tool 64 can thus be driven in rotation when the portable power tool 10 is in operation. The output unit 66 is connected to the drive unit 68 via a drive element (not represented in greater detail here) of the drive unit 68 that is realized as a pinion gear and that can be driven in rotation, in a manner already known to persons skilled in the art. In addition, an ancillary handle 70 is arranged on the output housing 58. When mounted on the output housing 58, the ancillary handle 70 extends transversely in relation to the direction of main extent 62 of the portable power tool 10.

Figure 2:
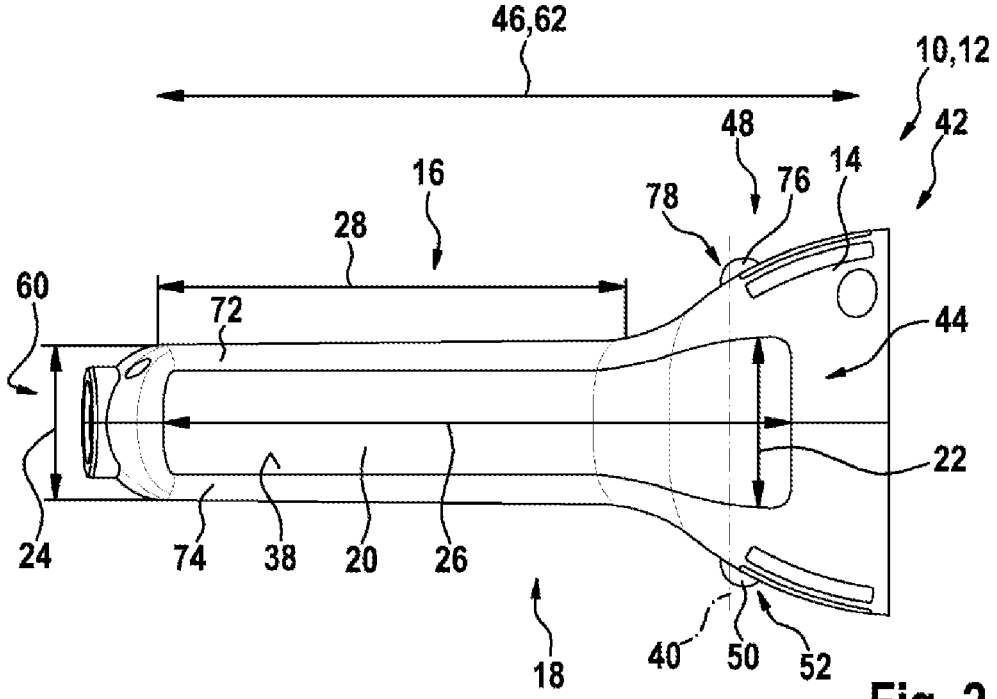
FIG. 2 shows a detail view of latch element of a switching unit of the power tool according to the disclosure, arranged on a handle housing of the power tool according to the disclosure, in a schematic representation.

FIG. 2 shows a detail view of the latch element 20 of the switching unit 18 arranged on the handle housing 14. The latch element 20 is mounted on the handle housing 14 so as to be pivotable about a pivot axis 40 of the latch element 20. The pivot axis 40 of the latch element 20 runs at least substantially perpendicularly in relation to the direction of main extent 46 of the handle housing 14, or at least substantially perpendicularly in relation to the direction of main extent 62 of the portable power tool 10. In this case, the pivot axis 40 runs at least substantially perpendicularly in relation to a joint plane of the handle housing 14. When in a mounted state, two handle housing shell elements 72, 74 of the handle housing 14 are joined together in the joint plane of the handle housing 14. The pivot axis 40 is arranged at an end 44 of the latch element 20 that faces toward the connecting region 42 of the handle housing 14. The latch element 20 is thus pivotally mounted at the end 44 that faces toward the connecting region 42 of the handle housing 14.

The latch element 20 has a maximum transverse extent 22 that extends at least over a major part of at least one maximum transverse extent 24 of the stem-type grip region 16 of the handle housing 14. In this case, a ratio of the maximum transverse extent 22 of the latch element 20 to the maximum transverse extent 24 of the stem-type grip region 16 of the handle housing 14 is at least greater than 1 to 2.5. The maximum transverse extent 22 of the latch element 20 runs along a direction that runs at least substantially perpendicularly in relation to the direction of main extent 46 of the handle housing 14, or at least substantially perpendicularly in relation to the direction of main extent 62 of the portable power tool 10, and at least substantially transversely at least in relation to a main direction of movement of the latch element 20. The maximum transverse extent 22 of the latch element 20 thus runs at least substantially parallelwise in relation to the pivot axis 40 of the latch element 20. The maximum transverse extent 24 of the stem-type grip region 16 of the handle housing 14 likewise runs along the direction that runs at least substantially perpendicularly in relation to the direction of main extent 46 of the handle housing 14, or at least substantially perpendicularly in relation to the direction of main extent 62 of the portable power tool 10, and at least substantially transversely at least in relation to a main direction of movement of the latch element 20.

Furthermore, the latch element 20 has a maximum longitudinal extent 26 that extends at least over a major part of a maximum longitudinal extent 28 of the stem-type grip region 16 of the handle housing 14. A ratio of the maximum longitudinal extent 26 of the latch element 20 to the maximum longitudinal extent 28 of the stem-type grip region 16 of the handle housing 14 is at least greater than 1 to 1.4. When the latch element 20 has been mounted on the handle housing 14, the maximum longitudinal extent 26 of the latch element extends along a direction that runs in the joint plane of the handle housing 14, and that runs at least substantially transversely in relation to a main direction of movement of the latch element 20. The maximum longitudinal extent 26 of the latch element 20 thus extends along a direction that runs at least substantially perpendicularly in relation to the pivot axis 40 of the latch element 20. The maximum longitudinal extent 28 of the stem-type grip region 16 of the handle housing 14 likewise extends along the direction that runs at least substantially perpendicularly in relation to the pivot axis 40 of the latch element 20.

Figure 3:
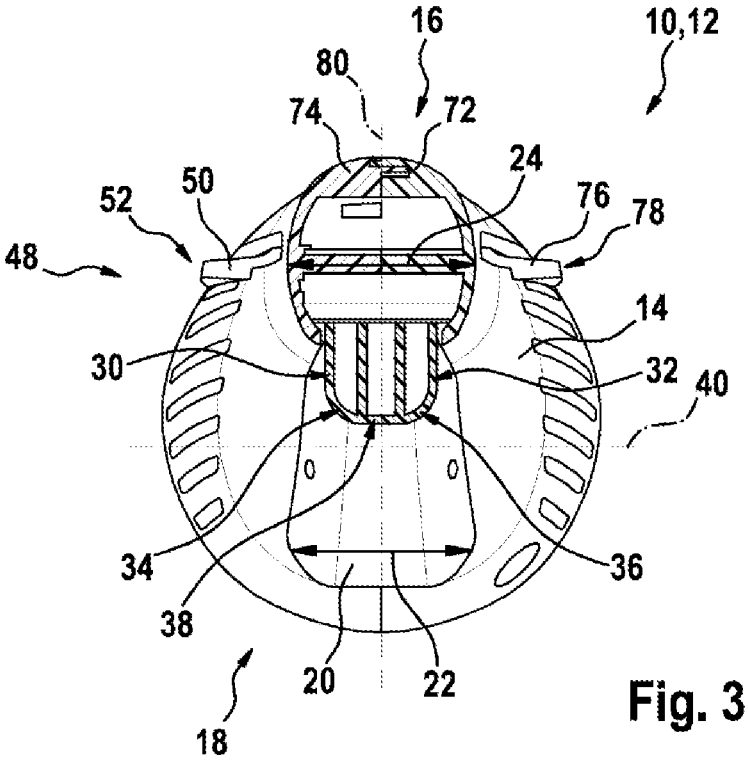
FIG. 3 shows a further detail view of the latch element arranged on the handle housing, in a schematic representation.

In addition, the latch element 20 has at least one side wall region 30, which is connected, via a bow-shaped sub-region 34 of the latch element 20, to a grip surface region 38 of the latch element 20 that runs at least substantially perpendicularly in relation to the side wall region 30, wherein a ratio of a radius of the bow-shaped sub-region 34 to the maximum transverse extent 24 of the stem-type grip region 16 of the handle housing 14 is at least greater than 1 to 8 (FIG. 3). In total, the latch element 20 has two side wall regions 30, 32, each of which is respectively connected, via one of two bow-shaped sub-regions 34, 36 of the latch element 20, to the grip surface region 38 of the latch element 20 that runs at least substantially perpendicularly in relation to the side wall regions 30, 32. In this case, the grip surface region 38 of the latch element 20, as viewed along the direction of main extent 46 of the handle housing 14, extends at least over a major part of the maximum longitudinal extent 26 of the latch element 20. Moreover, the grip surface region 38 of the latch element 20, as viewed along the direction of main extent 46 of the handle housing 14, has an at least substantially flat course. Thus, the course of the grip surface region 38 of the latch element 20 is at least to a large extent dissociated from step-type offsets. It is also conceivable, however, for the grip surface region 38 of the latch element 20 to have at least one finger recess region, which is provided to receive at least one finger of a hand of an operator when the latch element 20 is being operated, or held.

Furthermore, the portable power tool 10 has at least one switch-on inhibitor unit 48, which is provided to avoid, at least to a large extent, a movement of the latch element 20 as a result of an unintentional actuation of the latch element 20. The switch-on inhibitor unit 48 is realized as a mechanical inhibitor unit. It is also conceivable, however, for the switch-on inhibitor unit 48 to be realized as an electrical and/or electronic inhibitor unit. The switch-on inhibitor unit 48 has at least one release element 50, which comprises an actuating region 52 that is arranged, at least partially, laterally next to one of the side wall regions 30, 32 of the latch element 20. Moreover, the switch-on inhibitor unit 48 has at least one further release element 76, which has an actuating region 78 that is arranged, at least partially, laterally next to one of the side wall regions 30, 32 of the latch element 20. One of the side wall regions 30, 32 faces toward the release element 50, and one of the side wall regions 30, 32 faces toward the further release element 76. In this case, the actuating regions 52, 78 of the release element 50 and of the further release element 76 are arranged at a distance from the respective side wall region 30, 32, in each case as viewed, starting from the joint plane of the handle housing 14, in a direction running at least substantially perpendicularly in relation to the joint plane of the handle housing 14 and away from the handle housing 14. The release element 50 and the further release element 76 are arranged in a mirror-symmetrical manner in respect of the joint plane of the handle housing 14. In addition, the release element 50 and the further release element 76 are mounted so as to be pivotable about a release pivot axis 80. The release pivot axis 80 in this case runs in the joint plane of the handle housing 14. In addition, the release pivot axis 80 runs at least substantially perpendicularly in relation to the pivot axis 40 of the latch element 20.

In an alternative design of the portable power tool 10, which is not represented in greater detail here, it is conceivable for the portable power tool 10, in addition to having the switch-on inhibitor unit 48, to have an electrical and/or electronic start-up inhibitor, which, for example, only allows the drive unit 68 to be supplied with electric power once a sensor unit of the portable power tool 10 senses a further hand of an operator being in contact with the ancillary handle 70, in addition to a hand being in contact with the handle housing 14, in particular with the stem-type grip region 16, and thus deactivates the electrical and/or electronic start-up inhibitor, via an open-loop and/or closed-loop control unit of the portable power tool 10, which evaluates and processes the sensed characteristic quantities, to enable the portable power tool 10 to be put into operation.

The invention claimed is:

1. A power tool, comprising:

at least one handle housing including (i) at least one stem-type grip region, and (ii) at least one switching unit that has at least one movably mounted latch element having a maximum transverse extent that extends at least over a major part of at least one maximum transverse extent of the at least one stem-type grip region of the at least one handle housing; and at least one switch-on inhibitor unit configured to avoid, at least to a large extent, a movement of the at least one movably mounted latch element as a result of an unintentional actuation of the at least one movably mounted latch element.

2. The power tool as claimed in claim 1, wherein a ratio of the maximum transverse extent of the at least one movably mounted latch element to the at least one maximum transverse extent of the at least one stem-type grip region of the at least one handle housing is at least greater than 1 to 2.5.

3. The power tool as claimed in claim 1, wherein the at least one movably mounted latch element has a maximum longitudinal extent that extends at least over a major part of a maximum longitudinal extent of the at least one stem-type grip region of the at least one handle housing.

4. The power tool at least as claimed in claim 3, wherein a ratio of the maximum longitudinal extent of the at least one movably mounted latch element to the maximum longitudinal extent of the at least one stem-type grip region of the at least one handle housing is at least greater than 1 to 1.4.

5. The power tool as claimed in claim 1, wherein:

the at least one movably mounted latch element has at least one side wall region, which is connected, via a bow-shaped sub-region of the at least one movably mounted latch element, to a grip surface region of the at least one movably mounted latch element that runs at least substantially perpendicularly in relation to the at least one side wall region, and a ratio of a radius of the bow-shaped sub-region to the at least one maximum transverse extent of the at least one stem-type grip region of the at least one handle housing is at least greater than 1 to 8.

6. The power tool as claimed in claim 1, wherein the at least one movably mounted latch element is mounted so as to be pivotable about a pivot axis of the at least one movably mounted latch element.

7. The power tool as claimed in claim 6, wherein the pivot axis is arranged at an end of the at least one movably mounted latch element that faces toward a connecting region of the at least one handle housing.

8. The power tool at least as claimed in claim 6, wherein the pivot axis of the at least one movably mounted latch element runs at least substantially transversely in relation to a direction of main extent of the at least one handle housing.

9. The power tool as claimed in claim 1, wherein the at least one switch-on inhibitor unit has at least one release element, which comprises an actuating region that is arranged, at least partially, laterally next to a side wall region of the at least one movably mounted latch element.

10. A power tool switching device of a power tool including at least one handle housing having at least one stem-type grip region, comprising:

at least one switching unit including at least one movably mounted latch element having a maximum transverse extent that extends at least over a major part of at least one maximum transverse extent of the at least one stem-type grip region of the at least one handle housing; and at least one switch-on inhibitor unit configured to avoid, at least to a large extent, a movement of the at least one movably mounted latch element as a result of an unintentional actuation of the at least one movably mounted latch element.

11. A power tool, comprising:

at least one handle housing including (i) at least one stem-type grip region, and (ii) at least one switching unit that has at least one movably mounted latch element having a maximum transverse extent that extends at least over a major part of at least one maximum transverse extent of the at least one stem-type grip region of the at least one handle housing, wherein:

the at least one movably mounted latch element has at least one side wall region, which is connected, via a bow-shaped sub-region of the at least one movably mounted latch element, to a grip surface region of the at least one movably mounted latch element that runs at least substantially perpendicularly in relation to the at least one side wall region, and a ratio of a radius of the bow-shaped sub-region to the at least one maximum transverse extent of the at least one stem-type grip region of the at least one handle housing is at least greater than 1 to 8.

* * * * *